US009331437B2

(12) United States Patent
Chen

(10) Patent No.: US 9,331,437 B2
(45) Date of Patent: May 3, 2016

(54) HIGH DEFINITION MULTIMEDIA INTERFACE SOCKET

(71) Applicant: AVerMedia TECHNOLOGIES, INC., New Taipei (TW)

(72) Inventor: Chao-Jung Chen, New Taipei (TW)

(73) Assignee: AVerMedia TECHNOLOGIES, INC., New Taipei (TW)

( * ) Notice: Subject to any disclaimer, the term of this patent is extended or adjusted under 35 U.S.C. 154(b) by 0 days.

(21) Appl. No.: 14/698,833

(22) Filed: Apr. 28, 2015

(65) Prior Publication Data

US 2015/0325963 A1 Nov. 12, 2015

(30) Foreign Application Priority Data

May 9, 2014 (TW) ..... 103208153 U
Aug. 8, 2014 (TW) ..... 103214199 U

(51) Int. Cl.
*H01R 4/50* (2006.01)
*H01R 13/74* (2006.01)
*H01R 13/6596* (2011.01)

(52) U.S. Cl.
CPC ..... *H01R 13/748* (2013.01); *H01R 13/6596* (2013.01)

(58) Field of Classification Search
CPC ..... H01R 13/6275; H01R 13/639
USPC ..... 439/953, 345, 378, 372
See application file for complete search history.

(56) References Cited

U.S. PATENT DOCUMENTS 6,149,451 A * 11/2000 Weber ..... H01R 13/6275 439/358
6,319,052 B1 * 11/2001 Chang ..... H01R 12/774 439/260
6,655,978 B2 * 12/2003 Lutsch ..... H01R 13/641 439/310
7,652,210 B2 * 1/2010 White ..... H01R 13/447 174/53
8,888,517 B2 * 11/2014 Becavin ..... H01R 13/74 439/153

* cited by examiner

*Primary Examiner* — Phuongchi T Nguyen
(74) *Attorney, Agent, or Firm* — CKC & Partners Co., Ltd.

(57) ABSTRACT

A high definition multimedia interface (HDMI) socket for fastening on a metallic chassis includes a main body, a connecting member and a plastic piece. The connecting member includes a slot portion and a bent portion. The slot portion has a first and a second ends. The first end is connected with the main body. The bent portion is connected with the second end and has a first abutting surface abutting against the inner surface. The plastic piece is connected with the main body and has two second abutting surfaces. When the first abutting surface abuts against the inner surface before the plastic piece is fastened on the metallic chassis, a gap exists between the second abutting surfaces and the inner surface. When the plastic piece is fastened on the metallic chassis, the plastic piece is deformed and the second abutting surfaces abut against the inner surface.

22 Claims, 7 Drawing Sheets

HIGH DEFINITION MULTIMEDIA INTERFACE SOCKET

RELATED APPLICATIONS

This application claims priority to Taiwanese Application Serial No. 103208153, filed May 9, 2014, and Taiwanese Application Serial No. 103214199, filed Aug. 8, 2014, the disclosures of which are incorporated herein by reference in their entireties.

BACKGROUND

1. Technical Field

The present disclosure relates to a high definition multimedia interface (HDMI) socket.

2. Description of Related Art

A high definition multimedia interface (HDMI) is a fully digital interface of audio and video transmission, which can transmit uncompressed audio and video signals. With the development of the electronic technology and the increasing demand of the users on picture and sound qualities of electronic devices, the application of the HDMI has become more and more popular. In addition, with only one single electric cable, a HDMI can transmit both audio and video signals simultaneously. Therefore, the installation difficulty of the HDMI is greatly reduced.

In practice, in order to transmit audio and video signals through a HDMI from one electronic device to another electronic device, the electric cables of the two electronic devices are connected in the form of a plug and a socket. Generally speaking, a HDMI socket of an electronic device is fastened inside the metallic chassis of the electronic device, with a slot exposed outwards, so as to allow a HDMI plug of another electronic device to plug in.

Traditionally, a HDMI socket of an electronic device is fastened inside the metallic chassis of the electronic device by two opposite metal pieces folded out from the HDMI socket, thereby fixing and electrically grounding the HDMI socket. However, the connecting portions between the metal pieces and the HDMI socket are generally small and narrow in size. When a HDMI plug of another electronic device is plugged into the HDMI socket even with shaking movements in some occasions, the metal pieces are easily to be deformed or fractured, thus causing the electrical grounding of the HDMI socket to be instable, further reducing the durability of the HDMI socket, and shortening the operational life of the HDMI socket.

SUMMARY

A technical aspect of the present disclosure is to provide a high definition multimedia interface (HDMI) socket for increasing the certainty of electrical grounding of the HDMI socket when being fastened on a metallic chassis. Moreover, the durability of the HDMI socket is also increased.

According to an embodiment of the present disclosure, a HDMI socket configured to be fastened on an inner surface of a metallic chassis is provided. The HDMI socket includes a main body, a connecting member and a plastic piece. The connecting member includes a slot portion and a bent portion. The slot portion has a first end and a second end. The first end is connected with the main body. The second end is configured to be engaged with a HDMI plug. The bent portion is connected with the second end and has a first abutting surface. The first abutting surface is configured to abut against the inner surface. The plastic piece is connected with the main body and has two second abutting surfaces respectively located at two opposite sides of the main body. When the first abutting surface abuts against the inner surface before the plastic piece is fastened on the metallic chassis, a gap exists between the second abutting surfaces and the inner surface. When the plastic piece is fastened on the metallic chassis, the plastic piece is deformed towards the inner surface, and the second abutting surfaces further abut against the inner surface.

In one or more embodiments of the present disclosure, the first abutting surface is located between the second abutting surfaces.

In one or more embodiments of the present disclosure, the first abutting surface and the second abutting surfaces are substantially in parallel with each other.

In one or more embodiments of the present disclosure, the slot portion is corresponding to an opening on the inner surface, and an outer dimension of the slot portion is smaller than an inner dimension of the opening.

In one or more embodiments of the present disclosure, an orthographic projection of the bent portion relative to the inner surface overlaps with a portion of the inner surface and a portion of the opening.

In one or more embodiments of the present disclosure, the plastic piece has two first through holes. The first through holes are respectively located on the second abutting surfaces, and locations of the first through holes are respectively corresponding to locations of two second through holes on the inner surface.

In one or more embodiments of the present disclosure, the HDMI socket further includes two nuts and two bolts. The nuts are respectively received in the first through holes. Each of the bolts passes through the corresponding second through hole and the corresponding first through hole, and locks up with the corresponding nut in sequence.

In one or more embodiments of the present disclosure, the plastic piece is an insulator.

In one or more embodiments of the present disclosure, the connecting member is an electrically conductive metal.

According to another embodiment of the present disclosure, a HDMI socket configured to be fastened on an inner surface of a metallic chassis is provided. The HDMI socket includes a main body, a connecting member and a plastic piece. The connecting member includes a slot portion, a bent portion and a protrusive portion. The slot portion has a first end and a second end. The first end is connected with the main body. The second end is configured to be engaged with a HDMI plug. The bent portion is connected with the second end and has a first abutting surface and a second abutting surface. The first abutting surface and the second abutting surface are respectively located at two opposite sides of the bent portion. The first abutting surface faces the inner surface. The protrusive portion is located at the first abutting surface for abutting against the inner surface. The plastic piece is connected with the main body and abuts against the second abutting surface. When the HDMI socket is fastened on the metallic chassis, the protrusive portion abuts against the inner surface.

In one or more embodiments of the present disclosure, the plastic piece has an end surface. The end surface abuts against the second abutting surface.

In one or more embodiments of the present disclosure, the plastic piece has an end surface. A portion of the bent portion is embedded into the plastic piece from the end surface of the plastic piece. The end surface of the plastic piece is located between the first abutting surface and the second abutting surface in a direction perpendicular to the end surface of the plastic piece.

In one or more embodiments of the present disclosure, the plastic piece has an end surface. A portion of the bent portion is embedded into the plastic piece from the end surface of the plastic piece. The end surface of the plastic piece is connected with the first abutting surface.

In one or more embodiments of the present disclosure, the plastic piece has an end surface. The bent portion is embedded into the plastic piece. A portion of the protrusive portion is exposed from the end surface of the plastic piece.

In one or more embodiments of the present disclosure, the protrusive portion has a height relative to the first abutting surface, and the height ranges from 0.1 mm to 0.15 mm.

In one or more embodiments of the present disclosure, the protrusive portion is a stamped structure on the bent portion. The protrusive portion protrudes from the second abutting surface towards the first abutting surface.

In one or more embodiments of the present disclosure, a cutting line exists between the protrusive portion and the bent portion. A bending line is formed by the connection of two opposite ends of the cutting line. The protrusive portion is warped from the second abutting surface towards the first abutting surface with the bending line as the fulcrum.

In one or more embodiments of the present disclosure, the plastic piece has a first through hole. A location of the first through hole is aligned with a second through hole on the inner surface.

In one or more embodiments of the present disclosure, the bent portion has a third through hole. The third through hole is communicated with the first abutting surface and the second abutting surface. The third through hole is aligned with the first through hole and the second through hole, and is connected between the first through hole and the second through hole.

In one or more embodiments of the present disclosure, the HDMI socket further includes a nut and a bolt. The nut is received in the first through hole. The bolt passes through the second through hole, the third through hole and the first through hole in sequence, and locks up with the nut.

In one or more embodiments of the present disclosure, the plastic piece is an insulator.

In one or more embodiments of the present disclosure, the connecting member is an electrically conductive metal.

When compared with the prior art, the embodiments of the present disclosure mentioned above have at least the following advantages:

(1) When the HDMI socket is fastened on the metallic chassis, the plastic piece of the HDMI socket is deformed towards the inner surface of the metallic chassis, and the second abutting surfaces of the plastic piece further abut the inner surface. Therefore, the bent portion of the connecting member can firmly abut against the inner surface of the metallic chassis, such that the certainty of the grounding requirement of the HDMI socket as being fastened on the metallic chassis is guaranteed.

(2) When the plastic piece is fastened on the metallic chassis, the plastic piece is deformed towards the inner surface of the metallic chassis, and the second abutting surfaces further abut against the inner surface. Therefore, when there is an external force for plugging a HDMI plug into the slot portion with shaking movements, the bolt at one side of the plastic piece and the second abutting surface at the other side of the plastic piece will generate a bending moment relative to the metallic chassis, so as to resist the changes of the relative positions of the plastic piece and the metallic chassis. The bent portion is thus prevented from being fractured due to deformation under stress. Consequently, the durability of the HDMI socket is increased.

(3) Since the first abutting surface of the bent portion is located between the second abutting surfaces of the plastic piece, when the second abutting surfaces further abut against the inner surface of the metallic chassis, the coverage of the contact area between the HDMI socket and the metallic chassis becomes bigger, as compared to the condition when only the first abutting surface abuts against the inner surface. Therefore, the stability of the HDMI socket as being fastened on the metallic chassis is increased.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
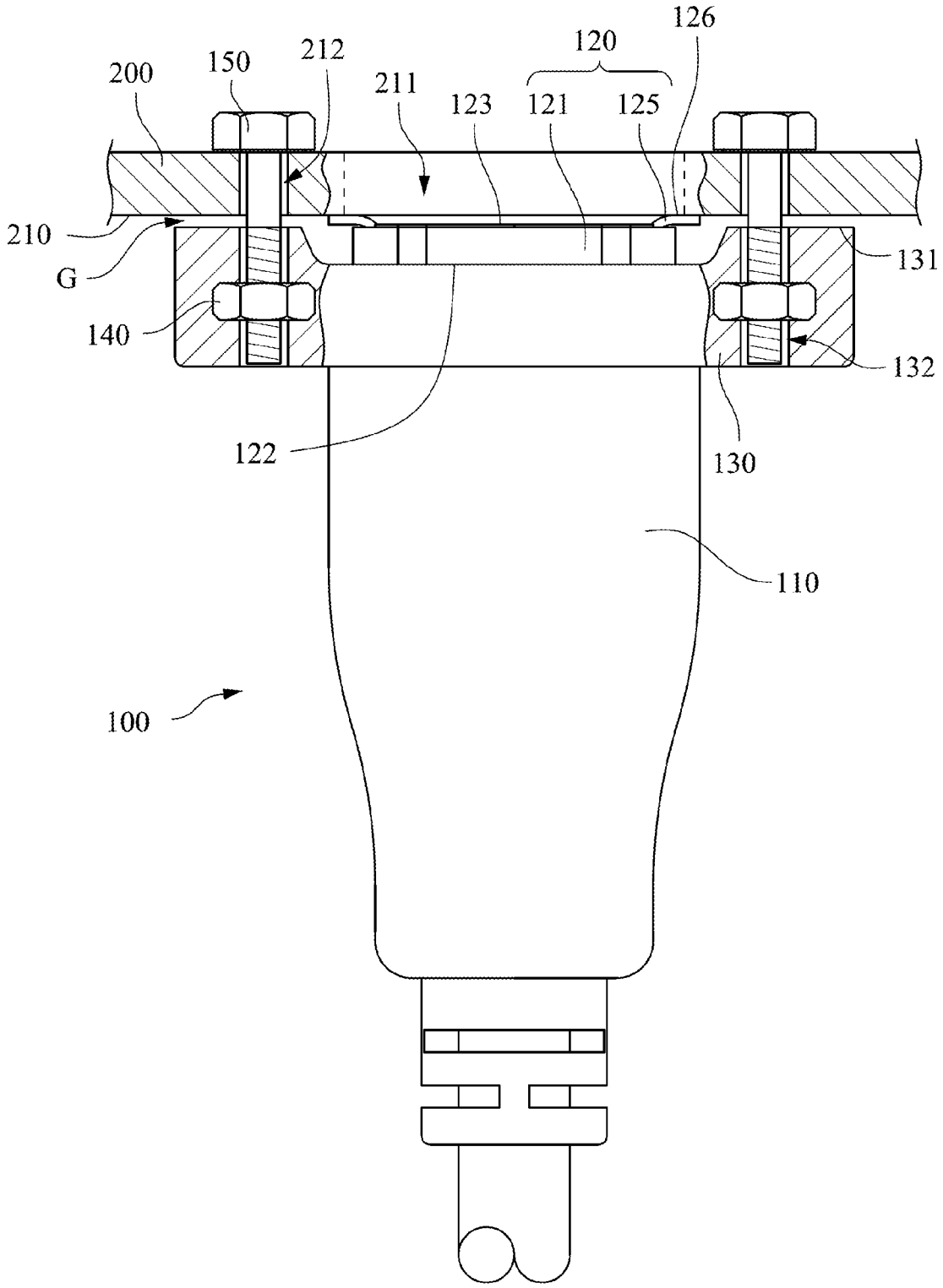
FIG. 1 is a partial cross-sectional schematic diagram of a high definition multimedia interface (HDMI) socket according to an embodiment of the present disclosure.

Drawings will be used below to disclose a plurality of embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Please refer to FIG. 1. FIG. 1 is a partial cross-sectional schematic diagram of a high definition multimedia interface (HDMI) socket 100 according to an embodiment of the present disclosure. As shown in FIG. 1, a HDMI socket 100 configured to being fastened on an inner surface 210 of a metallic chassis 200 is provided. The HDMI socket 100 includes a main body 110, a connecting member 120 and a plastic piece 130. The connecting member 120 includes a slot portion 121 and a bent portion 125. The slot portion 121 has a first end 122 and a second end 123. The first end 122 is connected with the main body 110. The second end 123 is configured to be engaged with a HDMI plug. The bent portion 125 is connected with the second end 123 and has a first abutting surface 126. The first abutting surface 126 is configured to abut against the inner surface 210. In this embodiment, the bent portion 125 and the slot portion 121 are of an integrally formed structure. However, t the present disclosure is not limited thereto.

Furthermore, the plastic piece 130 is connected with the main body 110, and has two second abutting surfaces 131. The second abutting surfaces 131 are respectively located at two opposite sides of the main body 110. When the first abutting surface 126 abuts against the inner surface 210 before the plastic piece 130 is fastened on the metallic chassis 200, a gap G exists between the second abutting surfaces 131 and the inner surface 210. In this embodiment, the distance of the gap G is about 0.15 mm, but the present disclosure is not limited thereto.

Figure 2:
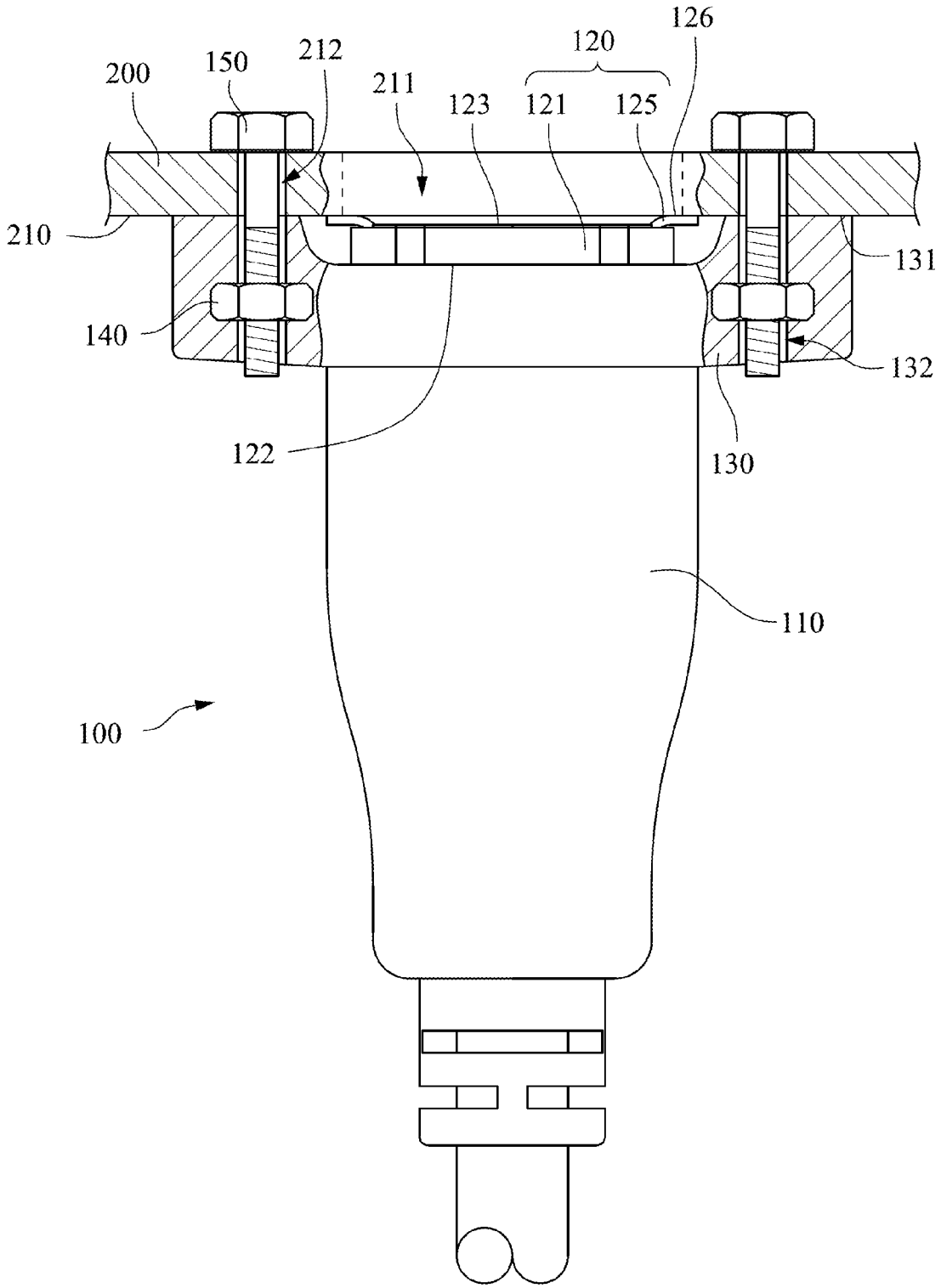
FIG. 2 is a partial cross-sectional schematic diagram of the HDMI socket of FIG. 1, in which the plastic piece is fastened on the metallic chassis.

Please refer to FIG. 2. FIG. 2 is a partial cross-sectional schematic diagram of the high definition multimedia interface socket 100 of FIG. 1, in which the plastic piece 130 is fastened on the metallic chassis 200. As shown in FIG. 2, when the plastic piece 130 is fastened on the metallic chassis 200, the plastic piece 130 is deformed towards the inner surface 210, and the second abutting surfaces 131 further abut against the inner surface 210. As a result, the bent portion 125 of the connecting member 120 is pressed and can firmly abut against the inner surface 210 of the metallic chassis 200, such that the bent portion 125 and the metallic chassis 200 are kept electrically connected. Therefore, the certainty of the grounding requirement of the HDMI socket 100 as being fastened on the metallic chassis 200 is guaranteed.

To be more specific, in this embodiment, the connecting member 120 is an electrically conductive metal, which means that the slot portion 121 and the bent portion 125 both are electrically conductive metals. When the HDMI socket 100 is stably fastened on the metallic chassis 200, as described above, since the first abutting surface 126 of the bent portion 125 abuts against the inner surface 210 of the metallic chassis 200, the HDMI socket 100 can be electrically connected to the metallic chassis 200 through the slot portion 121 and the bent portion 125.

Technically speaking, the first abutting surface 126 of the bent portion 125 and the second abutting surfaces 131 of the plastic piece 130 are substantially in parallel with each other. Therefore, when the second abutting surfaces 131 completely abut against the inner surface 210, the first abutting surface 126 also completely abuts against the inner surface 210. Thus, the HDMI socket 100 can be stably fastened on the metallic chassis 200.

On the other hand, in this embodiment, the plastic piece 130 is an insulator. As a result, when the HDMI socket 100 is stably fastened on the metallic chassis 200, i.e., when the second abutting surfaces 131 of the plastic piece 130 further abut against the inner surface 210 of the metallic chassis 200, the HDMI socket 100 will not be electrically connected with the metallic chassis 200 through the plastic piece 130.

As shown in FIGS. 1-2, the slot portion 121 of the connecting member 120 is corresponding to the opening 211 on the inner surface 210, and the outer dimension of the slot portion 121 is smaller than the inner dimension of the opening 211. The outer dimension of the slot portion 121 refers to the geometric dimensions of the outside of the slot portion 121, such as the length, the width and the height. The inner dimension of the opening 211 refers to the geometric dimensions of the inside of the opening 211, such as the length, the width and the height. Therefore, assuming the bent portion 125 does not exist, the slot portion 121 can pass though the opening 211 without touching the metallic chassis 200.

In this embodiment, as aforementioned, the bent portion 125 of the connecting member 120 is connected with the second end 123 of the slot portion 121, and the first abutting surface 126 of the bent portion 125 abuts against the inner surface 210 of the metallic chassis 200. Furthermore, the orthographic projection of the bent portion 125 relative to the inner surface 210 overlaps with a portion of the inner surface 210 and a portion of the opening 211. In other words, the bent portion 125 interferes with the inner dimension of the opening 211. Thus, the bent portion 125 hinders the slot portion 121 from passing through the opening 211, and the slot portion 121 can be electrically connected to the metallic chassis 200 through the bent portion 125.

As shown in FIGS. 1-2, the plastic piece 130 has two first through holes 132. The first through holes 132 are respectively located on the second abutting surfaces 131, and locations of the first through holes 132 are respectively corresponding to locations of two second through holes 212 on the inner surface 210 of the metallic chassis 200.

Furthermore, the HDMI socket 100 further includes two nuts 140 and two bolts 150. The nuts 140 are respectively received in the first through holes 132. Moreover, the shape of the first through hole 132 matches with that of the nut 140, such that the nut 140 cannot rotate in the first through hole 132. When the HDMI socket 100 is fastened on the metallic chassis 200, each of the bolts 150 passes through the corresponding second through hole 212 of the metallic chassis 200 and the corresponding first through hole 132 of the plastic piece 130 in sequence, and locks up with the corresponding nut 140 until the plastic piece 130 is deformed towards the inner surface 210 of the metallic chassis 200 and the second abutting surfaces 131 of the plastic piece 130 further abut against the inner surface 210. Since the nut 140 does not rotate in the first through hole 132, when the bolt 150 locks up with the nut 140, the bolt 150 can rotate relative to the nut 140, thereby enabling the bolt 150 to be smoothly coupled with the nut 140. It is noted that the way of locking between the HDMI socket 100 and the metallic chassis 200 as cited herein is merely illustrative and does not intend to limit the claimed scope. A person having ordinary skill in the art of the present disclosure should properly choose the way of locking between the HDMI socket 100 and the metallic chassis 200.

Through the coupling of the bolts 150 and the nuts 140, the plastic piece 130 of the HDMI socket 100 is deformed towards the inner surface 210 of the metallic chassis 200, and the second abutting surfaces 131 of the plastic piece 130 further abut against the inner surface 210. Besides the contact area between the HDMI socket 100 and the metallic chassis 200 is increased, since the first abutting surface 126 of the bent portion 125 is located between the second abutting surfaces 131 of the plastic piece 130, the coverage of the contact area between the HDMI socket 100 and the metallic chassis 200 becomes bigger, as compared to the condition when only the first abutting surface 126 abuts against the inner surface 210. Therefore, the stability of the HDMI socket 100 as fastened on the metallic chassis 200 is increased.

Together with the couplings of the bolts 150 and the nuts 140 as described above, the stability of the HDMI socket 100 as being fastened on the metallic chassis 200 is further increased. When there is an external force for plugging a HDMI plug into the slot portion 121 of the HDMI socket 100 with shaking movements, the bolt 150 at one side of the plastic piece 130 will be in tension, and the second abutting surface 131 at the other side will exert a compressing force on the inner surface 210 of the metallic chassis 200. Such tension and compressing forces will be alternately exerted along the shaking directions, such that the plastic piece 130 forms a corresponding bending moment relative to the metallic chassis 200, so as to resist the changes of the relative positions of the plastic piece 130 and the metallic chassis 200. The bent portion 125 is thus prevented from being fractured due to deformation under stress. Consequently, the durability of the HDMI socket is increased.

Figure 3:
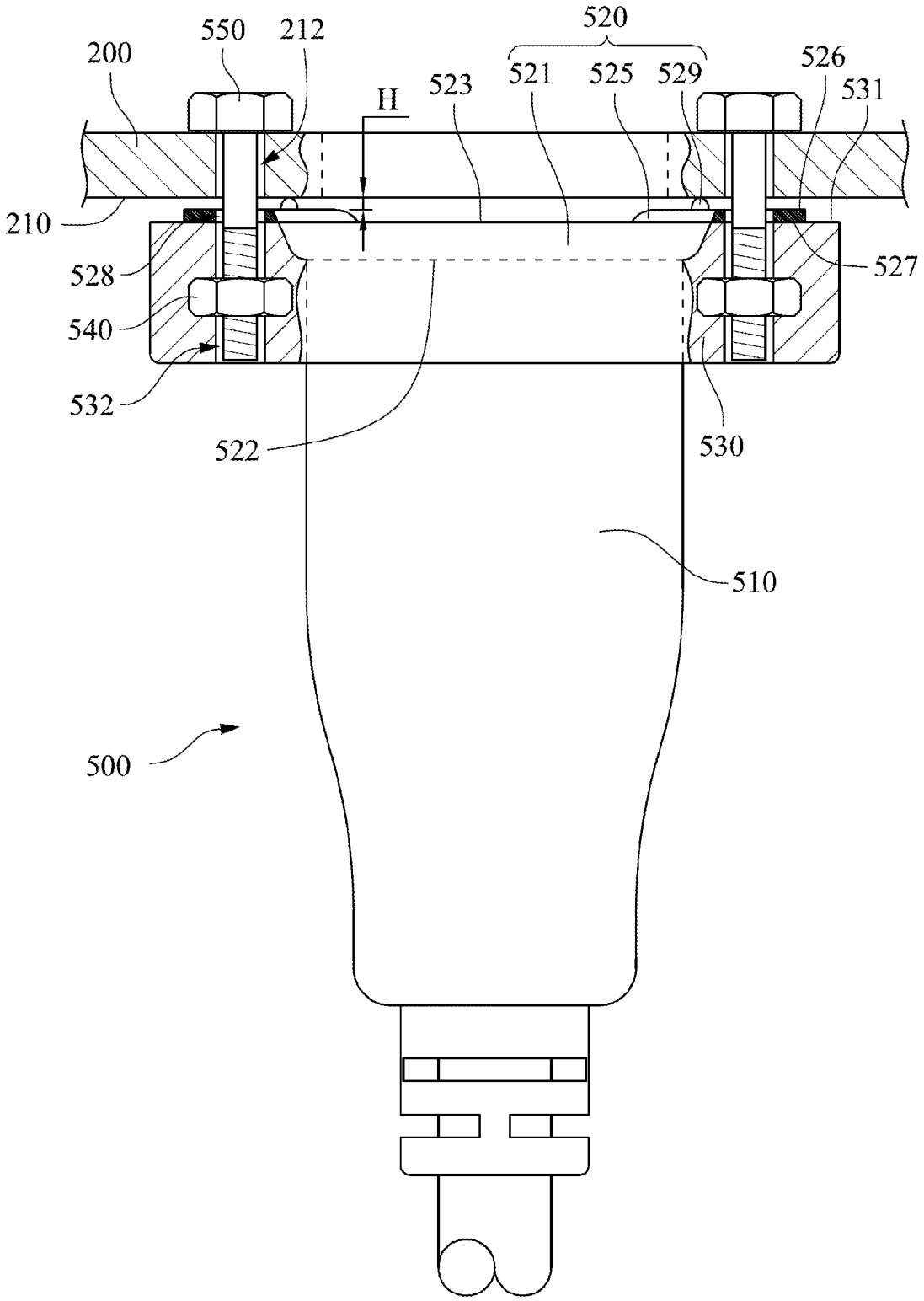
FIG. 3 is a partial cross-sectional schematic diagram of a HDMI socket according to another embodiment of the present disclosure.

Please refer to FIG. 3. FIG. 3 is a partial cross-sectional schematic diagram of a HDMI socket 500 according to another embodiment of the present disclosure. As shown in FIG. 3, the HDMI socket 500 includes a main body 510, a connecting member 520 and a plastic piece 530. The connecting member 520 includes a slot portion 521, a bent portion 525 and a protrusive portion 529. The slot portion 521 has a first end 522 and a second end 523. The first end 522 is connected with the main body 510. The second end 523 is configured to be engaged with a HDMI plug (now shown in FIG. 3). The bent portion 525 is connected with the second end 523 and has a first abutting surface 526 and a second abutting surface 527. The first abutting surface 526 and the second abutting surface 527 are respectively located at two opposite sides of the bent portion 525 (i.e., the upper and lower sides in FIG. 3). The first abutting surface 526 faces the inner surface 210. The protrusive portion 529 is located at the first abutting surface 526 for abutting against the inner surface 210. The plastic piece 530 is connected with the main body 510 and abuts against the second abutting surface 527. When the HDMI socket 500 is fastened on the metallic chassis 200, the protrusive portion 529 abuts against the inner surface 210.

In other words, since the first abutting surface 526 of the bent portion 525 faces the inner surface 210 of the metallic chassis 200, and the protrusive portion 529 is located at the first abutting surface 526, when the HDMI socket 500 is fastened on the metallic chassis 200, i.e., when the first abutting surface 526 and the inner surface 210 get close to each other, the protrusive portion 529 can abut the inner surface 210 before the first abutting surface 526 does. Therefore, the certainty of the contact between the bent portion 525 and the metallic chassis 200 is increased. In this embodiment, the protrusive portion 529 has a height H relative to the first abutting surface 526, and the height H ranges from 0.1 mm to 0.15 mm., but the present disclosure is not limited thereto.

To be more specific, in this embodiment, the connecting member 520 is an electrically conductive metal, meaning that the slot portion 521, the bent portion 525 and the protrusive portion 529 are all electrically conductive metals. Therefore, when the HDMI socket 500 is fastened on the metallic chassis 200, the HDMI socket 500 can be electrically connected with the metallic chassis 200 through the protrusive portion 529, the bent portion 525 and the slot portion 521. By increasing of the certainty of the contact between the bent portion 525 and the metallic chassis 200 due to the protrusive portion 529 which abuts the inner surface 210 before the first abutting surface 526 does, the certainty of the grounding requirement of the HDMI socket 500 as being fastened on the metallic chassis 200 is guaranteed.

On the other hand, in this embodiment, the plastic piece 530 is an insulator. Therefore, when the HDMI socket 500 is fastened on the metallic chassis 200, i.e., when the first abutting surface 526 and the inner surface 210 get close to each other such that the protrusive portion 529 abuts the inner surface 210, the HDMI socket 500 will not be electrically connected with the metallic chassis 200 through the plastic piece 530.

Furthermore, as shown in FIG. 3, the plastic piece 530 has an end surface 531, and the end surface 531 abuts against the second abutting surface 527 of the bent portion 525 (i.e., the end surface 531 and the second abutting surface 527 are located at the same level). As a result, the bent portion 525 is supported by the plastic piece 530, such that, when the HDMI socket 500 is fastened on the metallic chassis 200, the bent portion 525 will not be greatly deformed relative to the slot portion 521 due to the stress. The bent portion 525 is thus prevented from being fractured due to large deformation. Consequently, the durability and the operational life of the HDMI socket 500 are increased. In practical applications, when the HDMI socket 500 is stably fastened on the metallic chassis 200, the bent portion 525 together with the plastic piece 530 may experience slight deformation towards the inner surface 210. However, such slight deformation is not severe enough to damage the bent portion 525.

In this embodiment, the plastic piece 530 has a first through hole 532, and a location of the first through hole 532 is aligned with that of a second through hole 212 on the inner surface 210. Moreover, the bent portion 525 has a third through hole 528. The third through hole 528 is communicated with the first abutting surface 526 and the second abutting surface 527. The third through hole 528 is aligned with the first through hole 532 and the second through hole 212, and is connected between the first through hole 532 and the second through hole 212.

Furthermore, the HDMI socket 500 further includes a nut 540 and a bolt 550. The nut 540 is received in the first through hole 532. Moreover, the shape of the first through hole 532 matches with that of the nut 540, such that the nut 540 cannot rotate in the first through hole 532. When the HDMI socket 500 is fastened on the metallic chassis 200, the bolt 550 passes through the second through hole 212, the third through hole 528 and the first through hole 532 of the plastic piece 130 in sequence, and locks up with the nut 540 until the HDMI socket 500 is stably fastened on the metallic chassis 200. In this condition, the HDMI socket 500 and the metallic chassis 200 are electrically connected. In addition, since the nut 540 does not rotate in the first through hole 532, when the bolt 550 locks up with the nut 540, the bolt 550 can rotate relative to the nut 540, thereby enabling the bolt 550 smoothly coupled with the nut 540. It is noted that the way of locking between the HDMI socket 500 and the metallic chassis 200 as cited herein is merely illustrative and does not intend to limit the claimed scope. A person having ordinary skill in the art of the present disclosure should properly choose the way of locking between the HDMI socket 500 and the metallic chassis 200.

In practical applications, when there is an external force for plugging a HDMI plug into the slot portion 521 of the HDMI socket 500 with shaking movements, the bolt 550 at one side of the plastic piece 530 will be in tension, and the bent portion 525 at the other side will exert a compressing force on the inner surface 210 of the metallic chassis 200. Such tension and compressing forces will alternately exerted along with the shaking directions, such that the HDMI socket 500 instantly forms a corresponding bending moment relative to the metallic chassis 200, so as to resist the changes of the relative positions of the HDMI socket 500 and the metallic chassis 200. Since the bent portion 525 is supported by the plastic piece 530, the bent portion 525 will not be greatly deformed relative to the slot portion 521 due to the stress. The bent portion 525 is thus prevented from being fractured due to large deformation. Consequently, the durability and the operational life of the HDMI socket are increased.

In this embodiment, the protrusive portion 529 is a stamped structure on the bent portion 525, and the protrusive portion 529 protrudes from the second abutting surface 527 towards the first abutting surface 526. In other words, in the production process of the connecting member 520, the protrusive portion 529 and the bent portion 525 are of an integrally molded structure, but the present disclosure is not limited thereto.

Figure 4:
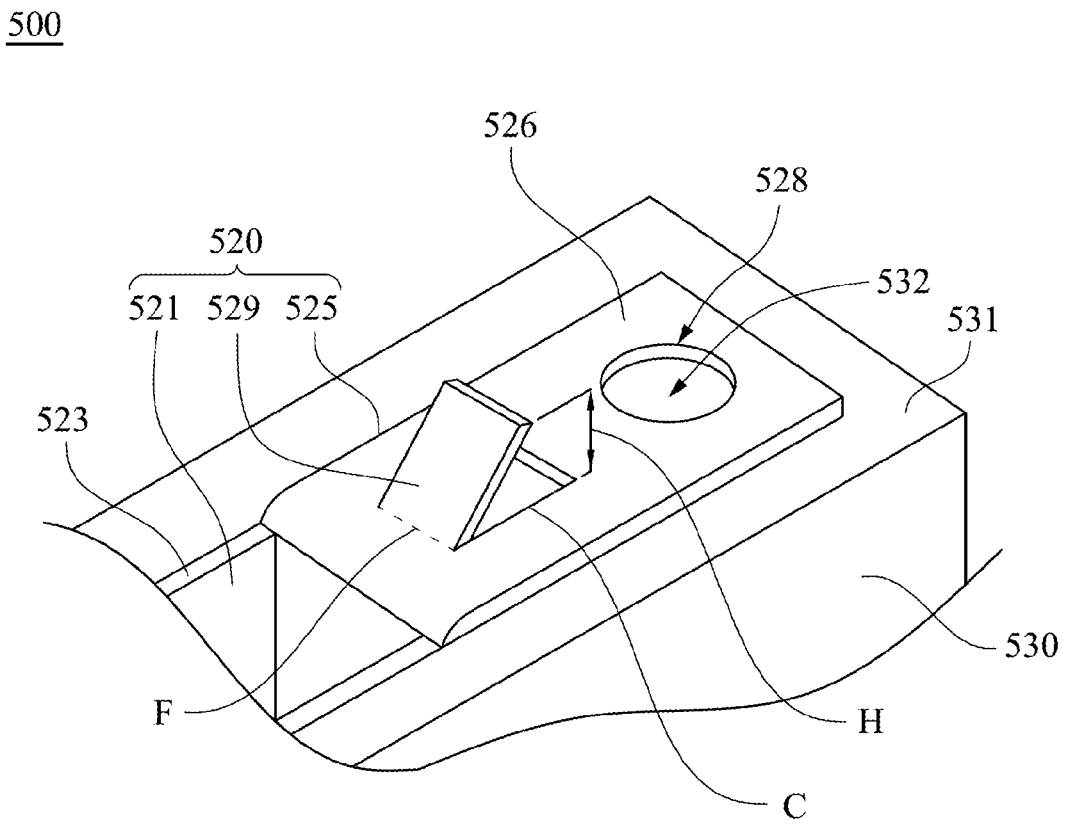
FIG. 4 is a partially perspective schematic diagram of a HDMI socket according to a further embodiment of the present disclosure.

Please refer to FIG. 4. FIG. 4 is a partially perspective schematic diagram of a HDMI socket 500 according to a further embodiment of the present disclosure. In this embodiment, as shown in FIG. 4, a cutting line C exists between the protrusive portion 529 and the bent portion 525. A bending line F is formed by the connection of two opposite ends of the cutting line C. The protrusive portion 529 is warped from the second abutting surface 527 towards the first abutting surface 526 with the bending line F as the fulcrum. As a result, when the HDMI socket 500 is fastened on the metallic chassis 200, the protrusive portion 529 can abut the inner surface 210 of the metallic chassis 200 before the first abutting surface 526 does. Therefore, the certainty of the contact between the bent portion 525 and the metallic chassis 200 is increased. In this embodiment, the cutting line C is in a "U" shape, but the present disclosure is not limited thereto. In practical applications, the cutting line C can also be in a "V" shape.

Figure 5:
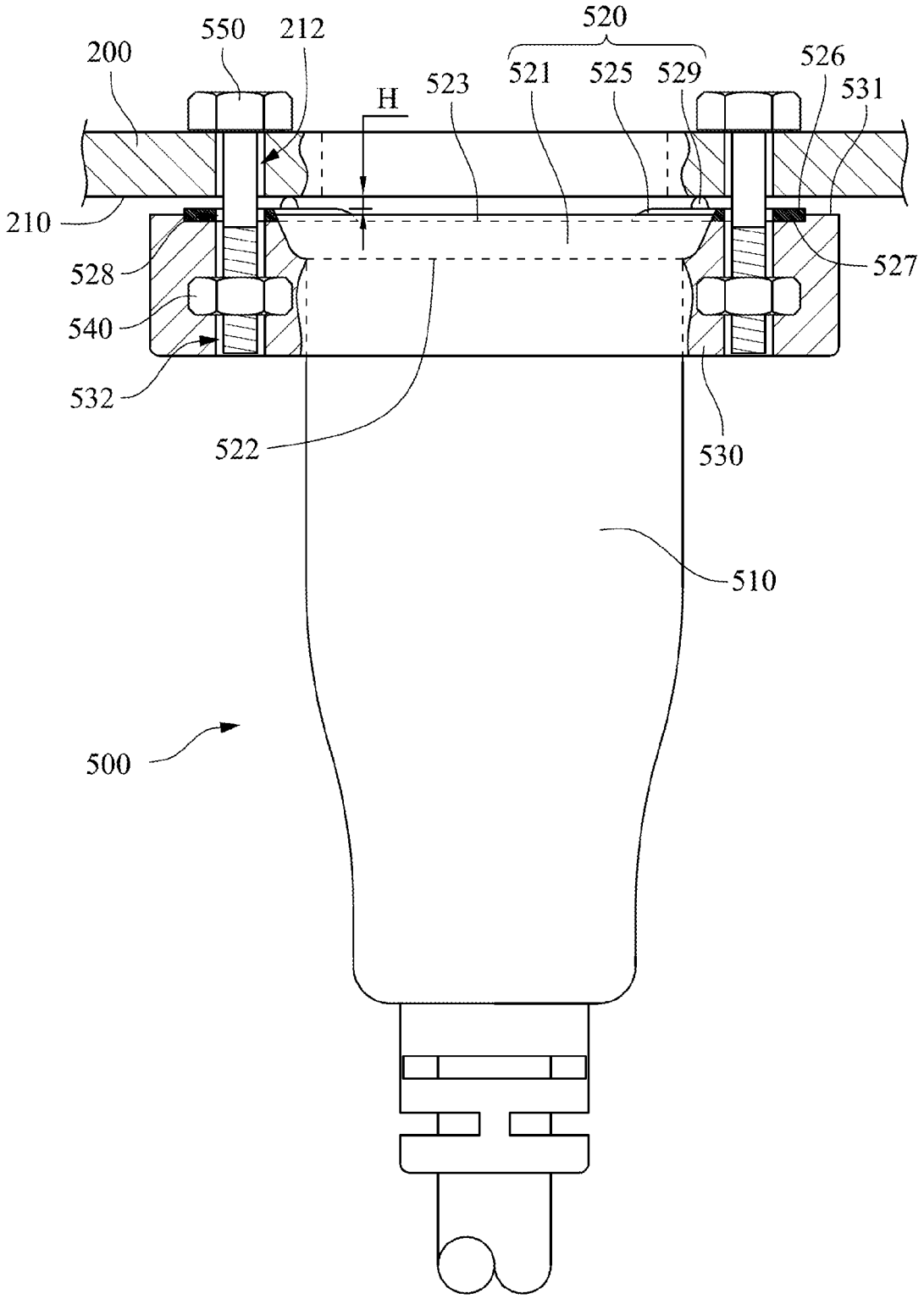
FIG. 5 is a partial cross-sectional schematic diagram of a HDMI socket according to another embodiment of the present disclosure.

Please refer to FIG. 5. FIG. 5 is a partial cross-sectional schematic diagram of a HDMI socket 500 according to another embodiment of the present disclosure. In this embodiment, as shown in FIG. 3, a portion of the bent portion 525 is embedded into the plastic piece 530 from the end surface 531, and the end surface 531 is located between the first abutting surface 526 and the second abutting surface 527 in a direction perpendicular to the end surface 531. As a result, as compared with the embodiments mentioned above, the bent portion 525 is supported by the plastic piece 530 even more firmly. Moreover, as the protrusive portion 529 is located at the first abutting surface 526, and has a height H relative to the first abutting surface 526, the protrusive portion 529 can still abut the inner surface 210 before the first abutting surface 526 does when the HDMI socket 500 is fastened on the metallic chassis 200, even though the bent portion 525 is embedded into the plastic piece 530 from the end surface 531, and the end surface 531 is located between the first abutting surface 526 and the second abutting surface 527. Therefore, the certainty of the contact between the bent portion 525 and the metallic chassis 200 is increased.

Figure 6:
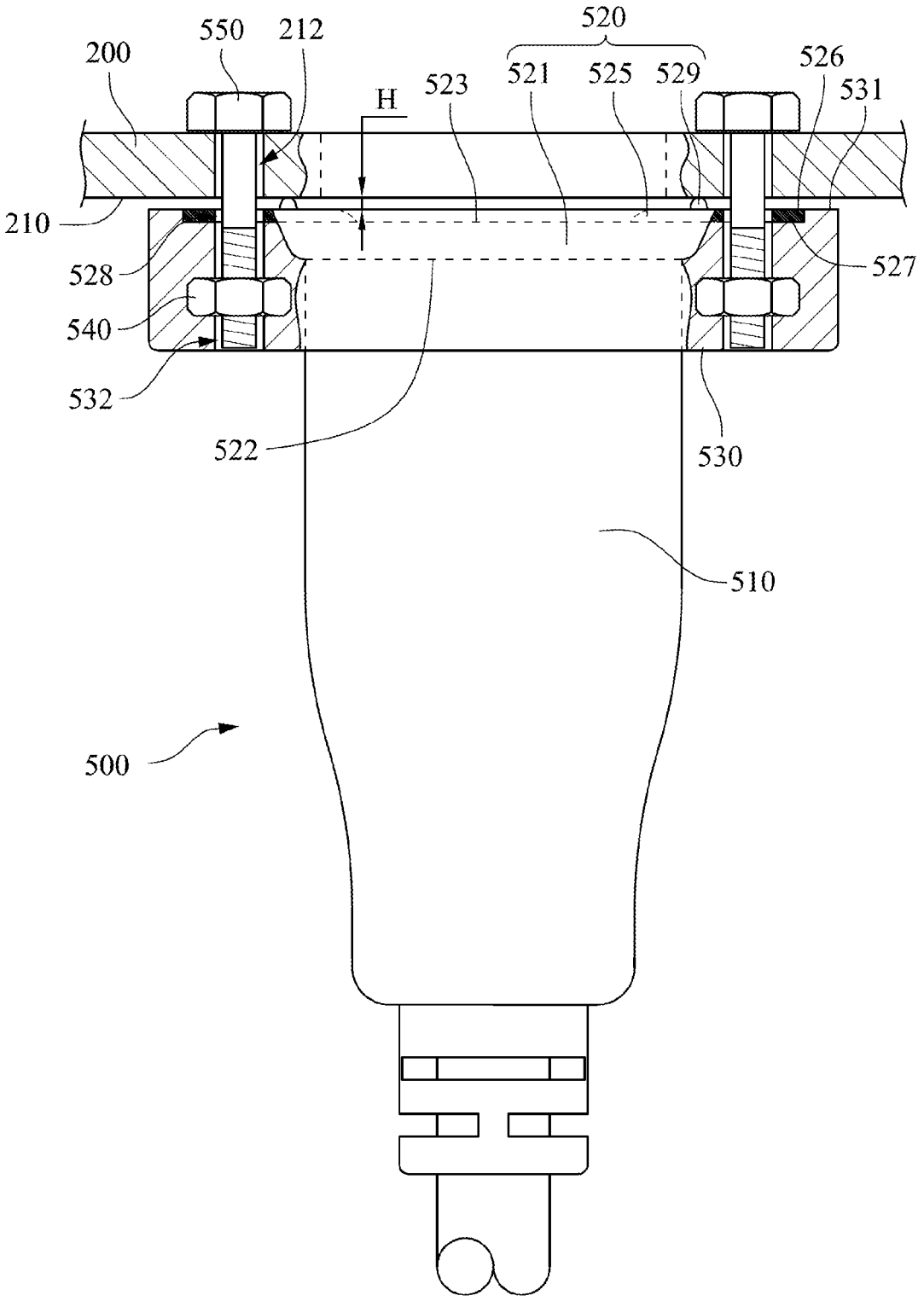
FIG. 6 is a partial cross-sectional schematic diagram of a HDMI socket according to a further embodiment of the present disclosure.

Please refer to FIG. 6. FIG. 6 is a partial cross-sectional schematic diagram of a HDMI socket 500 according to a further embodiment of the present disclosure. In this embodiment, as shown in FIG. 6, a portion of the bent portion 525 is embedded into the plastic piece 530 from the end surface 531, and the end surface 531 is connected with the first abutting surface 526 (i.e., the end surface 531 and the first abutting surface 526 are located at the same level). As a result, as compared with the embodiments mentioned above, the bent portion 525 is supported by the plastic piece 530 even more firmly. Similarly, as the protrusive portion 529 is located at the first abutting surface 526, and has a height H relative to the first abutting surface 526, the protrusive portion 529 can still abut the inner surface 210 before the first abutting surface 526 does when the HDMI socket 500 is fastened on the metallic chassis 200, even though a portion of the bent portion 525 is embedded into the plastic piece 530 from the end surface 531, and the end surface 531 is connected with the first abutting surface 526. Therefore, the certainty of the contact between the bent portion 525 and the metallic chassis 200 is increased.

Figure 7:
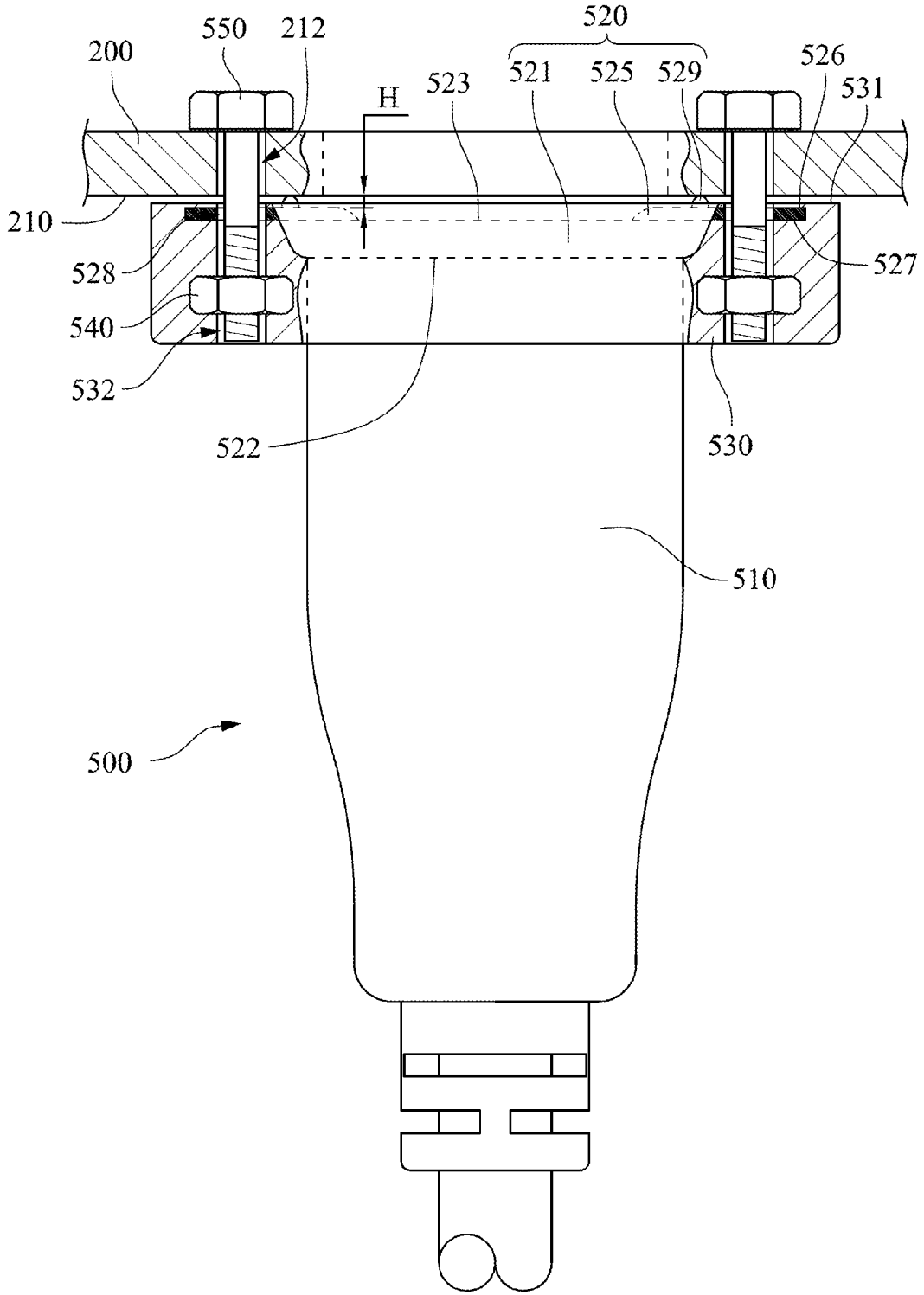
FIG. 7 is a partial cross-sectional schematic diagram of a HDMI socket according to another embodiment of the present disclosure.

Please refer to FIG. 7. FIG. 7 is a partial cross-sectional schematic diagram of a HDMI socket 500 according to another embodiment of the present disclosure. In this embodiment, as shown in FIG. 7, the bent portion 525 is embedded into the plastic piece 530, meaning that the end surface 531 is closer to the inner surface 210 of the metallic chassis 200 than the first abutting surface 526 is. However, since the protrusive portion 529 is located at the first abutting surface 526, and has a height H relative to the first abutting surface 526, at least a portion of the protrusive portion 529 can be exposed from the end surface 531 provided that the depth of the first abutting surface 526 embedded into the end surface 531 is smaller than the height H. As a result, even though the end surface 531 is closer to the inner surface 210 than the first abutting surface 526 is, the protrusive portion 529 can still abut the inner surface 210 before the first abutting surface 526 does when the HDMI socket 500 is fastened on the metallic chassis 200. Therefore, the certainty of the contact between the bent portion 525 and the metallic chassis 200 is increased.

In brief, provided that the protrusive portion 529 is closer to the inner surface 210 of the metallic chassis 200 than the end surface 131 is, the protrusive portion 529 can still abut the inner surface 210 before the first abutting surface 526 does when the HDMI socket 500 is fastened on the metallic chassis 200. Therefore, the certainty of the contact between the bent portion 525 and the metallic chassis 200 is increased, such that the certainty of the grounding requirement of the HDMI socket 500 as fastened on the metallic chassis 200 is also guaranteed.

In summary, when compared with the prior art, the aforementioned embodiments of the present disclosure have at least the following advantages:

(1) When the HDMI socket is fastened on the metallic chassis, the plastic piece of the HDMI socket is deformed towards the inner surface of the metallic chassis, and the second abutting surfaces of the plastic piece further abut the inner surface. Therefore, the bent portion of the connecting member can firmly abut against the inner surface of the metallic chassis, such that the certainty of the grounding requirement of the HDMI socket as being fastened on the metallic chassis is guaranteed.

(2) When the plastic piece is fastened on the metallic chassis, the plastic piece is deformed towards the inner surface of the metallic chassis, and the second abutting surfaces further abut against the inner surface. Therefore, when there is an external force for plugging a HDMI plug into the slot portion with shaking movements, the bolt at one side of the plastic piece and the second abutting surface at the other side of the plastic piece will generate a bending moment relative to the metallic chassis, so as to resist the changes of the relative positions of the plastic piece and the metallic chassis. The bent portion is thus prevented from being fractured due to deformation under stress. Consequently, the durability of the HDMI socket is increased.

(3) Since the first abutting surface of the bent portion is located between the second abutting surfaces of the plastic piece, when the second abutting surfaces further abut against the inner surface of the metallic chassis, the coverage of the contact area between the HDMI socket and the metallic chassis becomes bigger, as compared to the condition when only the first abutting surface abuts against the inner surface. Therefore, the stability of the HDMI socket as being fastened on the metallic chassis is increased.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A high definition multimedia interface (HDMI) socket configured to be fastened on an inner surface of a metallic chassis, the HDMI socket comprising:

a main body;

a connecting member, comprising:

a slot portion having a first end and a second end, wherein the first end is connected with the main body, and the second end is configured to be engaged with a HDMI plug, and;

a bent portion which is connected with the second end and has a first abutting surface configured to abut against the inner surface; and a plastic piece which is connected with the main body and has two second abutting surfaces respectively located at two opposite sides of the main body, wherein when the first abutting surface abuts against the inner surface before the plastic piece is fastened on the metallic chassis, a gap exists between the second abutting surfaces and the inner surface, and when the plastic piece is fastened on the metallic chassis, the plastic piece is deformed towards the inner surface, and the second abutting surfaces further abut against the inner surface.

2. The HDMI socket of claim 1, wherein the first abutting surface is located between the second abutting surfaces.

3. The HDMI socket of claim 1, wherein the first abutting surface and the second abutting surfaces are substantially in parallel with each other.

4. The HDMI socket of claim 1, wherein the plastic piece is an insulator.

5. The HDMI socket of claim 1, wherein the connecting member is an electrically conductive metal.

6. The HDMI socket of claim 1, wherein the slot portion is corresponding to an opening on the inner surface, and an outer dimension of the slot portion is smaller than an inner dimension of the opening.

7. The HDMI socket of claim 6, wherein an orthographic projection of the bent portion relative to the inner surface overlaps with a portion of the inner surface and a portion of the opening.

8. The HDMI socket of claim 1, wherein the plastic piece has two first through holes respectively located on the second abutting surfaces, and locations of the first through holes are respectively corresponding to locations of two second through holes on the inner surface.

9. The HDMI socket of claim 8, further comprising:

two nuts respectively received in the first through holes; and two bolts each of which passes through the corresponding second through hole and the corresponding first through hole in sequence, and locks up with the corresponding nut.

10. A high definition multimedia interface (HDMI) socket, configured to be fastened on an inner surface of a metallic chassis, the HDMI socket comprising:

a main body;

a connecting member, comprising:

a slot portion having a first end and a second end, wherein the first end is connected with the main body, and the second end is configured to be engaged with a HDMI plug;

a bent portion connected with the second end and having a first abutting surface and a second abutting surface, the first abutting surface and the second abutting surface being respectively located at two opposite sides of the bent portion, wherein the first abutting surface faces the inner surface; and a protrusive portion located at the first abutting surface for abutting against the inner surface; and a plastic piece connected with the main body and abutting against the second abutting surface;

wherein when the HDMI socket is fastened on the metallic chassis, the protrusive portion abuts against the inner surface.

11. The HDMI socket of claim 10, wherein the plastic piece has an end surface, and the end surface abuts against the second abutting surface.

12. The HDMI socket of claim 10, wherein the plastic piece has an end surface, a portion of the bent portion is embedded into the plastic piece from the end surface of the plastic piece, and the end surface of the plastic piece is located between the first abutting surface and the second abutting surface in a direction perpendicular to the end surface of the plastic piece.

13. The HDMI socket of claim 10, wherein the plastic piece has an end surface, a portion of the bent portion is embedded into the plastic piece from the end surface of the plastic piece, and the end surface of the plastic piece is connected with the first abutting surface.

14. The HDMI socket of claim 10, wherein the plastic piece has an end surface, the bent portion is embedded into the plastic piece, and a portion of the protrusive portion is exposed from the end surface of the plastic piece.

15. The HDMI socket of claim 10, wherein the protrusive portion has a height relative to the first abutting surface, and the height ranges from 0.1 mm to 0.15 mm.

16. The HDMI socket of claim 10, wherein the protrusive portion is a stamped structure on the bent portion, and the protrusive portion protrudes from the second abutting surface towards the first abutting surface.

17. The HDMI socket of claim 10, wherein a cutting line exists between the protrusive portion and the bent portion, a bending line is formed by the connection of two opposite ends of the cutting line, and the protrusive portion is warped from the second abutting surface towards the first abutting surface with the bending line as the fulcrum.

18. The HDMI socket of claim 10, wherein the plastic piece has a first through hole, and a location of the first through hole is aligned with a second through hole on the inner surface.

19. The HDMI socket of claim 10, wherein the bent portion has a third through hole, the third through hole is communicated with the first abutting surface and the second abutting surface, and the third through hole is aligned with the first through hole and the second through hole and is connected between the first through hole and the second through hole.

20. The HDMI socket of claim 10, further comprising:

a nut received in the first through hole; and a bolt passing through the second through hole, the third through hole, and the first through hole, and locking up with the nut in sequence.

21. The HDMI socket of claim 10, wherein the plastic piece is an insulator.

22. The HDMI socket of claim 10, wherein the connecting member is an electrically conductive metal.

* * * * *